United States Patent [19]

Ebihara

[11] Patent Number: 4,756,462

[45] **Date of Patent: * Jul. 12, 1988**

[54] CASSETTE TYPE STAPLER

[75] Inventor: Yoshiyuki Ebihara, Tokyo, Japan

[73] Assignee: Etona Company Limited, Japan

[ * ] Notice: The portion of the term of this patent subsequent to Aug. 26, 2003 has been disclaimed.

[21] Appl. No.: 896,202

[22] Filed: Aug. 14, 1986

[30] Foreign Application Priority Data

Oct. 17, 1985 [JP] Japan ..... 60-232119

[51] Int. Cl.[4] ..... B25C 5/02

[52] U.S. Cl. ..... 227/120; 227/156

[58] Field of Search ..... 227/120, 127, 128, 156

[56] References Cited

U.S. PATENT DOCUMENTS

| | | | |
|---|---|---|---|
| 2,495,385 | 1/1950 | Palmer | 227/128 |
| 2,801,414 | 8/1957 | Mueller | 227/127 |
| 3,630,428 | 12/1971 | Olney et al. | 227/128 |
| 3,862,712 | 1/1975 | LaPointe et al. | 227/127 |
| 4,405,073 | 9/1983 | Escalante | 227/120 |
| 4,477,008 | 10/1984 | Struble | 227/120 |
| 4,607,777 | 8/1986 | Ebihara | 227/120 |

*Primary Examiner*—E. R. Kazenske
*Assistant Examiner*—James L. Wolfe
*Attorney, Agent, or Firm*—Andrus, Sceales, Starke & Sawall

[57] ABSTRACT

The present invention provides a cassette type stapler comprising a base member, a cassette receiving member pivotably connected with the base member and including a hollow portion with a forward opened end and a rearward closed end, a handle member pivotably mounted on the cassette receiving member, a cassette containing a set of staples to be driven and inserted into the cassette receiving member through the forward opened end thereof and a locking lever pivotably connected with the cassette receiving member and having a latching end adapted to penetrate into aligned openings on the cassette and cassette receiving member when the cassette is completely received in the cassette receiving member.

2 Claims, 2 Drawing Sheets

CASSETTE TYPE STAPLER

BACKGROUND OF THE INVENTION

1. Field of the Invention

The present invention relates to a cassette type stapler.

2. Description of the Prior Art

In Japanese Patent Application Ser. No. 207838/1985, filed Sept. 20, 1985 by Yoshiyuki Ebihara and entitled "CASSETTE TYPE STAPLER", the inventor's have proposed a stapler of such a type that a cassette containing a set of staples is charged into a holder member mounted between a base and a handle. In this proposal, the cassette is adapted to be inserted into the interior of the holder member through the rearward opened end thereof. In such an arrangement, the cassette is held within the holder member only under the friction created between the cassette and the inner walls of the holder member. When any external force is exerted on the cassette, it may be displaced such that the staple driving openings in the forward end of the cassette is brought into dis-alignment with a driving path between an actuating element of the handle and an anvil of the base.

SUMMARY OF THE INVENTION

It is therefore an object of the present invention to provide a cassette type stapler in which a cassette containing a set of staples is charged into a cassette receiving member through the forward opened end thereof and which includes means for rigidly holding the cassette within the cassette receiving member.

To accomplish the above object, the present invention provides a cassette type stapler comprising a base member, a cassette receiving member pivotably mounted on the base member, said cassette receiving member being in the form of a hollow member having a forward opened end and a rearward closed end, a handle member pivotably mounted on the cassette receiving member, a cassette containing a set of staples to be driven and being inserted into the hollow portion of said cassette receiving member through said forward opened end such that the forward staple driving apertures of the cassette will be aligned with a driving path between an actuating element on the handle member and an anvil on the base member, and means for locking the cassette within the cassette receiving member in position.

DESCRIPTION OF PREFERRED EMBODIMENTS

Figure 1:
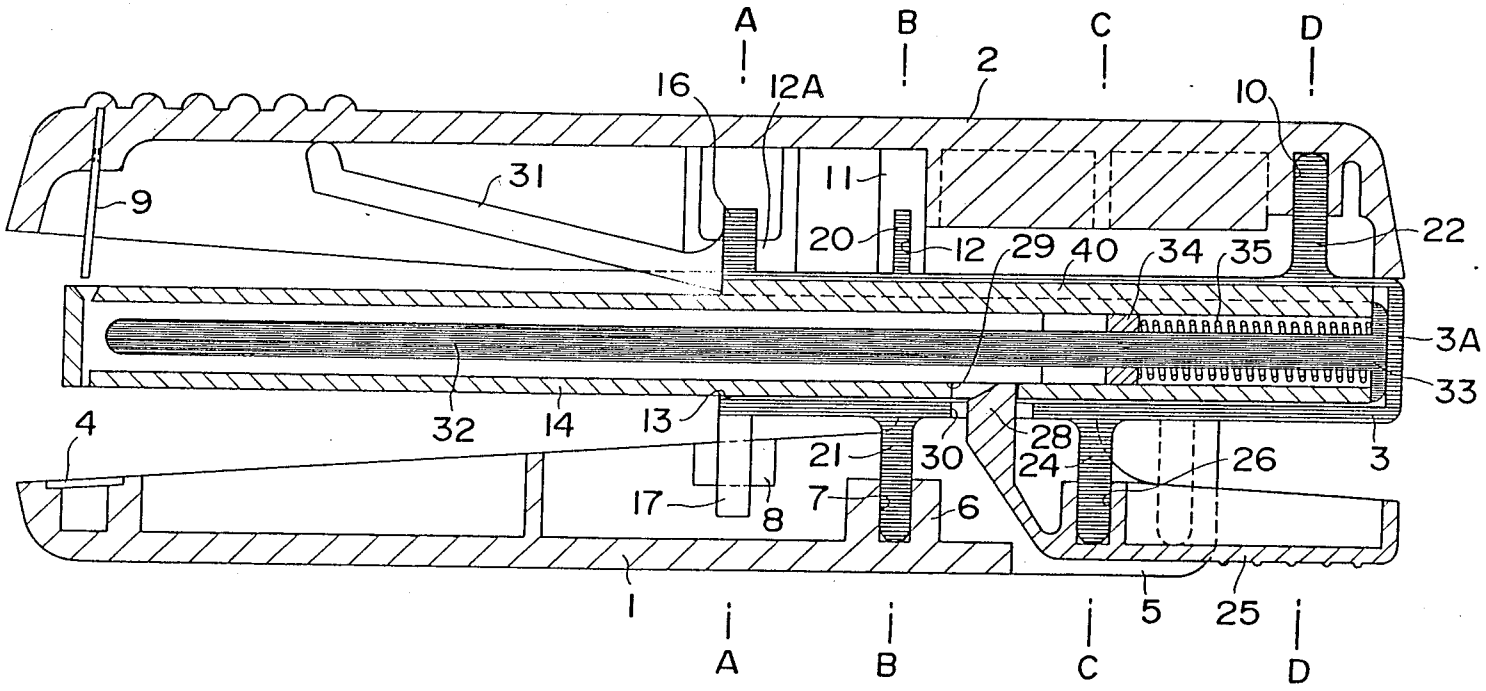
FIG. 1 is a longitudinal section of a cassette type stapler constructed in accordance with the present invention.
Figure 5:
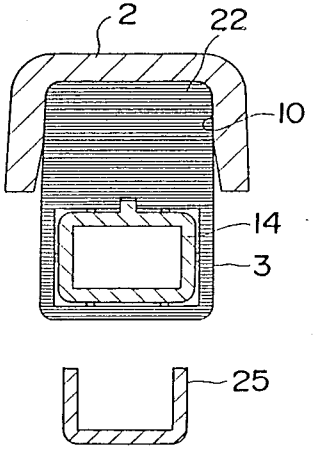
FIG. 5 is a cross-sectional view taken along a line D—D in FIG. 1.
Figure 4:
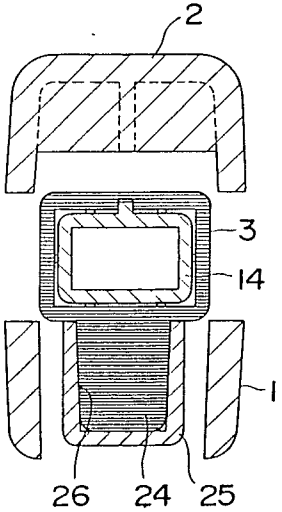
FIG. 4 is a cross-sectional view taken along a line C—C in FIG. 1.
Figure 3:
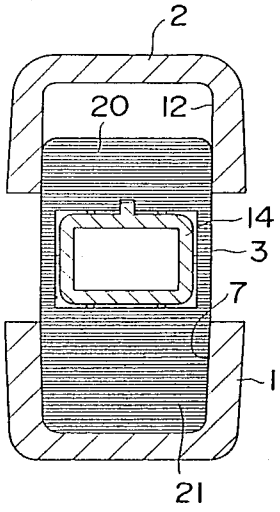
FIG. 3 is a cross-sectional view taken along a line B—B in FIG. 1.

Referring to the drawings, there is shown a cassette type stapler which generally comprises a base member 1, a handle member 2 and a cassette receiving member

3 mounted between the base and handle members. All the members are preferably made of any suitable plastics material.

Figure 2:
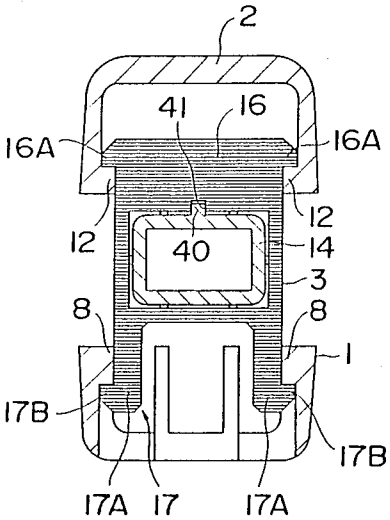
FIG. 2 is a cross-sectional view taken along a line A—A in FIG. 1.

The base member 1 is in the form of an elongated member including a metallic well-known anvil 4 adjacent to the forward end thereof. The rearward end of the base member 1 is formed with a cut-out portion 5 for a purpose described hereinafter. The base member 1 includes a boss 6 immediately forwardly of the cut-out portion 5 in the interior of the base member 1. The boss 6 has a top opened recess 7 formed therein for a purpose described hereinafter. As best seen from FIG. 2, the opposite side inner walls of the base member 1 are respectively formed with inwardly and laterally extending lugs 8 which will also be described hereinafter.

The handle member 2 also is in the form of an elongated member similar to the base member 1. The forward end of the handle member 2 includes a metallic actuating element 9 which is well-known in the art. The rearward end of the handle member 2 includes a recess 10 formed therein at its top inner wall for a purpose described hereinafter. The top inner wall of the handle member 2 is formed also with a boss 11 positioned forwardly of the recess 10 substantially at the central portion thereof. The boss 12 has a bottom opened recess 12 formed therein for a purpose described hereinafter. As best seen from FIG. 2, the opposite side inner walls of the handle member 2 include inwardly and laterally extending lugs 12A formed therein forwardly of the boss 11 substantially at the central position. The function of these lugs 12A will also be described hereinafter.

The cassette receiving member 3, which is mounted between the handle member 2 and the base member 1, is in the form of a hollow member having a forward opened end 13 and a rearward end which is closed by an end plate 3A. The hollow portion of the cassette receiving member 3 is adapted to receive a cassette 14 in which a set of staples are charged. The cassette 14 will be described in more detail hereinafter.

The cassette receiving member 3 includes latching elements 16 and 17 which extend in the opposite directions perpendicular to the longitudinal axis of the member 3. The upper latching element 16 includes lateral projections 16A extending outwardly from the opposite sides thereof. On assembling, the lateral projections 16A on the upper latching element 16 are engaged by the inner lugs 12A of the handle member 2 to connect the latter with the cassette receiving member 3. The lower latching element 17 is bifurcated into two latching parts 17A each of which has a lateral projection 17B extending outwardly from the side wall thereof. On assembling, the lateral projections 17B on the lower latching element 17 are engaged by the respective inner lugs 8 on the base member 1 to connect the latter with the cassette receiving member 3.

The cassette receiving member 3 also includes pivot plates 20 and 21 extending therefrom perpendicular to the longitudinal axis of the cassette receiving member 3 in the opposite directions and rearwardly of the respective latching elements 16 and 17. The upper pivot plate 20 is received in the recess 12 of the handle member 2 while the lower pivot plate 21 is received in the recess 7 of the base member 1. Thus, each of the handle and base members 2 and 1 can be pivoted about the corresponding pivot plate 20 and 21 within a limited range.

A plate-like element 22 extends upwardly and perpendicularly adjacent to the rearward end of the cassette receiving member 3 and is slidably received in the recess 10 on the rearward end of the handle member 2. This plate-like element 22 functions to guide the rotation of the handle member 2 such that it can positively be pivoted along a given path. As a result, the actuating element 9 can positively follow its given path when the handle member 2 is pivoted relative to the cassette receiving member 3.

A particular pivot plate 24 extends downwardly and perpendicularly from the bottom of the cassette receiving member 3 adjacent to and rearwardly of the lower plate-like member 21. The pivot plate 24 is received in a recess 26 formed in a locking lever 25 which is disposed in the cut-out portion 5 on the rearward end of the base member 1. When the rearward end of the locking lever 25 is manually pressed against the cassette receiving member 3, the locking lever 25 can be pivoted under the deflection of the pivot plate 24. The locking lever 25 includes an upwardly extending latching element 28 formed therein at the inner end thereof. When the cassette 14 is inserted into the cassette receiving member 3 and if a latching opening 29 on the bottom of the cassette 14 is aligned with an opening 30 formed through the bottom wall of the cassette receiving member 3, the latching element 28 of the locking lever 25 penetrates into the aligned openings 29 and 30 to engage the rearward edge of the latching opening 29 in the cassette 14 such that the cassette 14 will positively be held within the cassette receiving member 3. In the illustrated embodiment, the above alignment of the openings 29 and 30 is obtained when the cassette 14 is completely positioned within the hollow portion of the cassette receiving member 3 with the rearward end face of the cassette 14 engaged by the end plate 3A by which the rearward end of the cassette receiving member 3 is closed. The forward edge of the latching element 28 on the locking lever 25 is chamfered to facilitate the passage of the rearward edge of the cassette 14 over the latching element 20 when the cassette 14 is inserted into the cassette receiving member 3.

When the cassette 14 is to be removed from the cassette receiving member 3, the locking lever 25 is simply manually pressed against the cassette receiving member 3. As a result, the latching element 28 is retracted out of the aligned openings 29 and 30. Thereafter, the cassette 14 can easily be removed out of the cassette receiving member 3.

A spring plate 31 extends upwardly and forwardly from the cassette receiving member 3 adjacent to the upper latching element 16. On assembling, the spring plate 31 engages the inner top wall of the handle member 2 to bias it upwardly for a purpose which is well-known in the art. Since the lateral projections 16A of the upper latching element 16 on the cassette receiving member 3 engage the lateral lugs 12 on the handle member 2, the latter will not be rotated beyond an undesirable range under the action of the spring plate 31.

The cassette 14 may be similar to one which has been proposed by the inventor in Japanese Patent Application Ser. No. 207838/1985. When the cassette 14 is completely positioned within the cassette receiving member 3, it is required only that the staple driving ports on the forward end of the cassette 14 should be aligned with a given driving path between the actuating element 9 and the anvil 4. Briefly, a set of staples are charged into the hollow portion of the cassette 14. A feeder is inserted into the hollow portion of the cassette 14. The feeder comprises a guide rod 32, a closure cap 33 formed integrally on the rearward end of the guide rod 32, a guide 34 slidably mounted on the forward or inward end of the guide rod 32 and a coil spring 35 mounted about the guide rod 32 between the guide 34 and the closure cap 33. When the feeder is set in the cassette 14, the set of staples therein are urged toward the forward end of the cassette 14 through the guide 34 under the action of the coil spring 35. The guide rod 32, closure cap 33 and guide 34 may be made of any suitable plastics material.

As best seen from FIGS. 2 through 5, the cassette 14 includes a ridge 40 formed on the top face of the cassette 14 and extending along the length thereof. The inner top face of the cassette receiving member 3 includes a corresponding guide groove 41 formed therein which co-operates with the ridge 40 of the cassette 14 to facilitate the insertion of the cassette 14 into the cassette receiving member 3 in a proper orientation. Such guide means may take one of various different configurations. For example, the ridge may be formed on the top inner wall of the cassette receiving member 3 while the guide groove may be formed on the top face of the cassette 14. Such ridge and groove construction may also be formed between the bottom of the cassette 14 and the bottom inner wall of the cassette receiving member 3 or between the opposite sides of the cassette and cassette receiving member 14, 3.

If almost all the parts of the stapler are made of a plastics material, each of these parts may be molded as a unit. This facilitates both the manufacturing and assembling of such a cassette type stapler.

I claim:

1. A cassette type stapler comprising a base member, a cassette receiving member pivotably mounted on the base member, a handle member pivotably mounted on the cassette receiving member, said cassette receiving member being in the form of a hollow member having a forward opened end and a rearward closed end, a cassette containing a set of staples to be driven and being inserted into the hollow portion of said cassette receiving member through said forward opened end such that the forward staple driving apertures of the cassette will be aligned with a given driving path between an actuating element on the handle member and an anvil on the base member, and means for locking the cassette within the cassette receiving member in position, said handle member including a recess adapted to receive a pivot plate formed on said cassette receiving member at a position adjacent to the rearward end thereof such that said handle member can be pivoted about said pivot plate.

2. A cassette type stapler comprising a base member, a cassette receiving member pivotably mounted on the base member, a handle member pivotably mounted on the cassette receiving member, said cassette receiving member being in the form of a hollow member having a forward opened end and a rearward closed end, a cassette containing a set of staples to be driven and being inserted into the hollow portion of said cassette receiving member through said forward opened end such that the forward staple driving apertures of the cassette will be aligned with a given driving path between an actuating element on the handle member and an anvil on the base member, and means for locking the cassette within the cassette receiving member in position, said base member including a recess adapted to receive a pivot plate formed on said cassette receiving member substantially at the central position between the opposite ends such that said base member can be pivoted about said pivot plate.

* * * * *